US007074095B2

(12) United States Patent
Perng

(10) Patent No.: US 7,074,095 B2
(45) Date of Patent: Jul. 11, 2006

(54) CAR BATTERY POST FIXING STRUCTURE

(76) Inventor: Te-Yu Perng, P.O. Box No. 6-57, Junghe, Taipei 235 (TW)

( * ) Notice: Subject to any disclaimer, the term of this patent is extended or adjusted under 35 U.S.C. 154(b) by 26 days.

(21) Appl. No.: 10/978,396

(22) Filed: Nov. 2, 2004

(65) Prior Publication Data

US 2006/0094303 A1 May 4, 2006

(51) Int. Cl.
*H01R 4/38* (2006.01)

(52) U.S. Cl. ..... 439/766

(58) Field of Classification Search ..... 439/766, 439/755, 756, 433, 805, 957, 765
See application file for complete search history.

(56) References Cited

U.S. PATENT DOCUMENTS 2,571,145 A * 10/1951 Barron ..... 439/766
6,152,785 A * 11/2000 Haller et al. ..... 439/766
6,902,434 B1 * 6/2005 Stack ..... 439/621

* cited by examiner

*Primary Examiner*—Phuong Dinh

(74) *Attorney, Agent, or Firm*—Troxell Law Office, PLLC

(57) ABSTRACT

A car battery post fixing structure for installation on a car battery post structure enables facilitating connection with terminals of a car electrical system. The invention includes a fixing cap and a cap nut, wherein a screw thread is configured on an outside wall of the fixing cap, which allows the cap nut to screw down thereon. Furthermore, a screw thread is in an inverse direction to that of the screw thread of the outside wall, is configured on an inside wall of the fixing cap, moreover, a plurality of grooves are defined on a side edge of an opening of a bottom portion of the fixing cap. An extended screw is configured on a top portion of the fixing cap, and when installing, rigid tightening of the fixing cap onto a battery post is realized, which not only achieves convenience in installing, moreover, provides greater safety.

2 Claims, 7 Drawing Sheets

CAR BATTERY POST FIXING STRUCTURE

BACKGROUND OF THE INVENTION (a) Field of the Invention

The present invention relates to a car battery post fixing structure, and more particularly to the fixing structure that is fitted atop a car battery post structure, which thereby facilitates connecting with terminals of a car electrical system.

(b) Description of the Prior Art

Referring to FIG. 1, which shows a conventional car battery post structure connected to an internal negative, positive plate. Electric current is released by means of a chemical change within a car battery, and electricity flows through a connection between post fixing structures and electrical system terminals of a car, thereby supplying the electric current required by the car. Majority of post structures a1 utilized by a car battery a are of a cylindrical form, and after first fixing a ferrule b on the post structure a1, the electrical system terminal of the car can then be firmly connected thereto. The fixing ferrule b is slightly oval-shaped with a gap b1, and internal diameter of the ferrule b is slightly smaller than that of the column-shaped post structure a1. Locking pieces b2, which are of same size as the post structure a1, separately protrude from each of two sides of the gap b1, and a hole b21 is defined in a center of each of the locking pieces b2. Fixing screws c are further utilized to clamp the two locking pieces b2 onto the post structure a1 of the battery a, thereby securing structural configuration thereof. The locking pieces b2 are often not securely tightened during installation or become loose when the car is moving, which not only prevents the battery a from storing electricity, moreover, sparks are produced. Because the car battery a is structured as an electric accumulator, after the battery a has undergone charging, and during subsequent charging, water in an electrolyte of the battery a is caused to undergo hydrolysis, and result of the hydrolysis is production of oxygen at a positive electrode, and production of hydrogen at a negative electrode, whereafter the oxygen and hydrogen are released. If the fixing ferrule b has not been firmly tightened, during driving of the car, because car body jumps about continuously, sparks are produced at the battery posts, and there is a possibility of the battery exploding. Hence, there is a need for improvement in the conventional car battery post fixing structure.

SUMMARY OF THE INVENTION

In light of aforementioned shortcomings of a conventional configuration, the inventor of the present invention, having accumulated years of experience in related arts, attentively and circumspectly carried out extensive study and exploration to ultimately design a completely new and improved car battery post fixing structure.

A primary objective of the present invention is to provide a battery post fixing structure that is convenient to install, and, moreover, provides greater safety.

In order to achieve the aforementioned objective the car battery post fixing structure of the present invention is structured to comprise a fixing cap and a cap nut, wherein interior of the fixing cap is formed to correspond to same shape of a battery post, and internal diameter of the fixing cap is slightly smaller than that of the battery post. A screw thread is configured on an outside wall of the fixing cap, and a screw thread, which is of type that is in a inverse direction to that of the screw thread of the outside wall, is configured on an inside wall of the fixing cap. Moreover, a plurality of grooves are defined on a side edge of an opening of a bottom portion of the fixing cap, and an extended screw is configured on a top portion external of the fixing cap.

Based on the aforementioned structure, when installing, the fixing caps are slipped onto each of the battery posts, and because the inside wall of the fixing cap is provided with the screw thread, and the bottom opening is provided with four grooves, and, moreover, because the battery posts assume a slight taper-shape, thus, the closer the fixing cap is to a base of the battery post, the more a base of the fixing cap is pushed open. Furthermore, the screw thread on the inside wall of the fixing cap can further add to tapping of the lead battery post. When the cap nut is configuredly slipped onto the fixing cap, rapid and convenient tightening of the pushed open fixing cap onto the battery post is realized. Because each of the battery posts and the fixing structures are in tight contact, and, moreover, contact surfaces are enclosed interior of the fixing cap, thus, not only is production of sparks reduced, moreover, explosions caused by the sparks coming in contact with gases produced from the battery are prevented. Hence, safety aspect of the structure is enhanced, and oxidation of the battery posts is avoided, thereby achieving effectiveness of prolonging service life of the battery posts.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
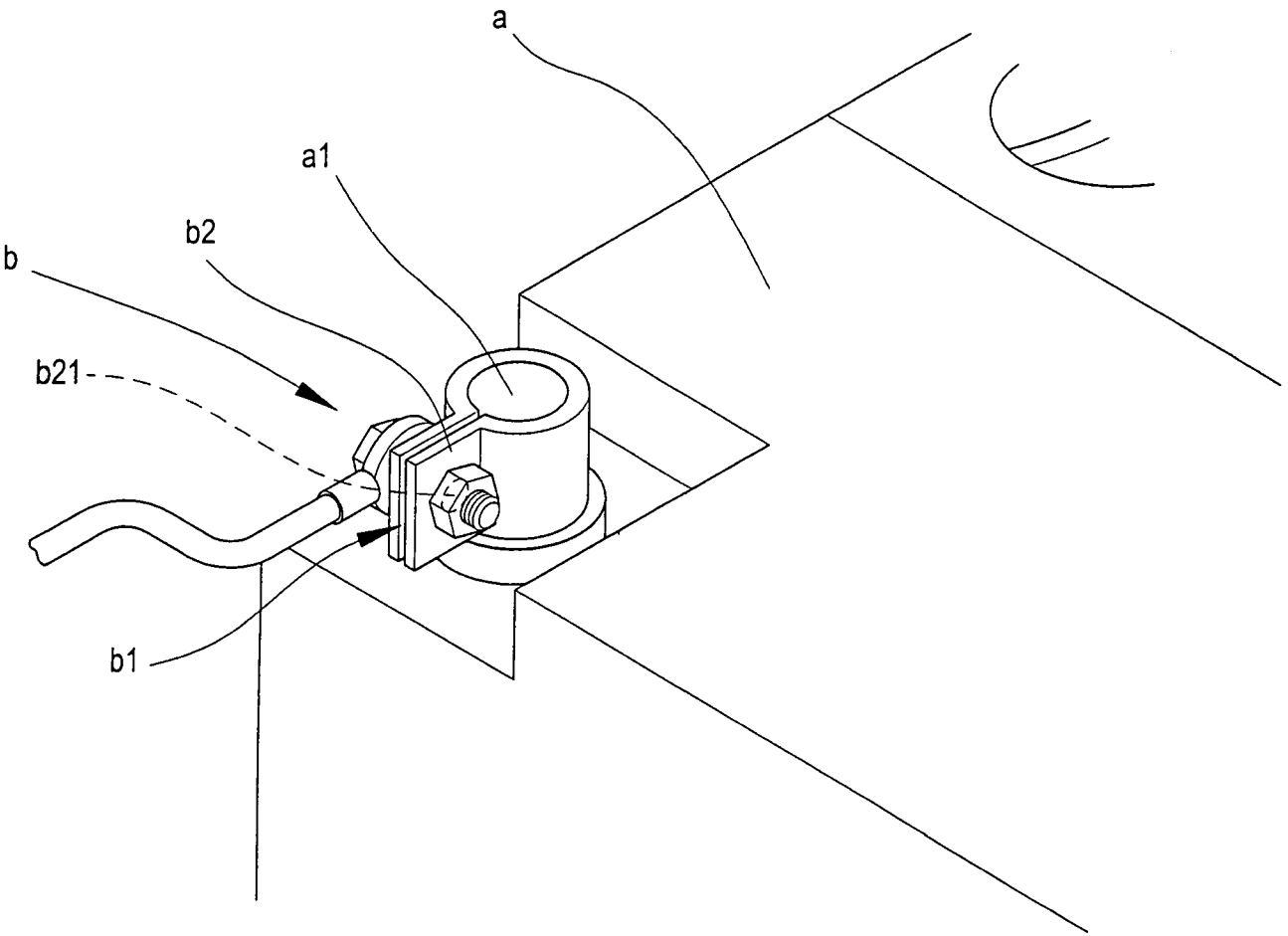
FIG.1 Prior Art
FIG. 1 shows an elevational view of a conventional post fixing structure.
Figure 2:
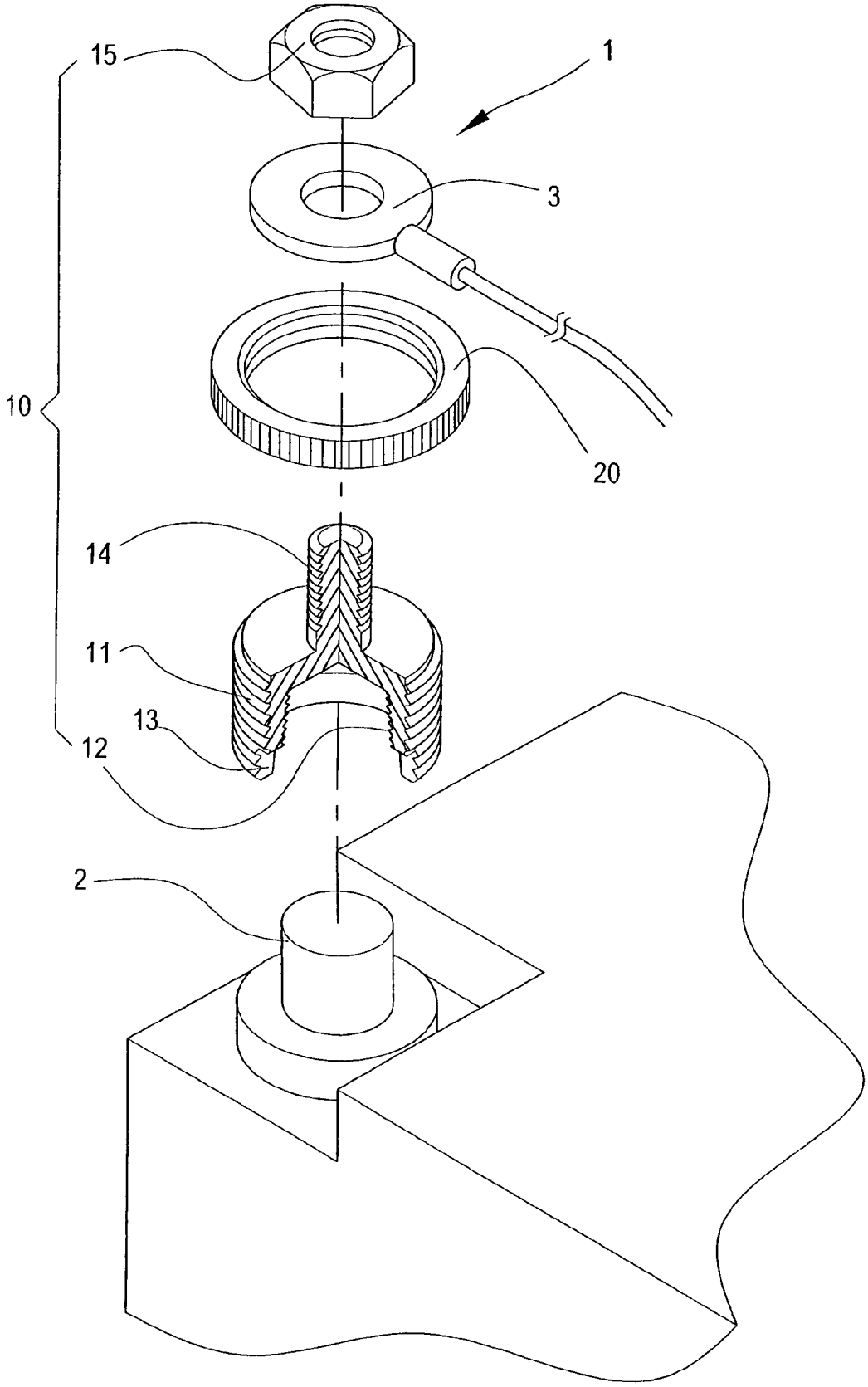
FIG. 2 shows an exploded elevational view according to the present invention.
Figure 3:
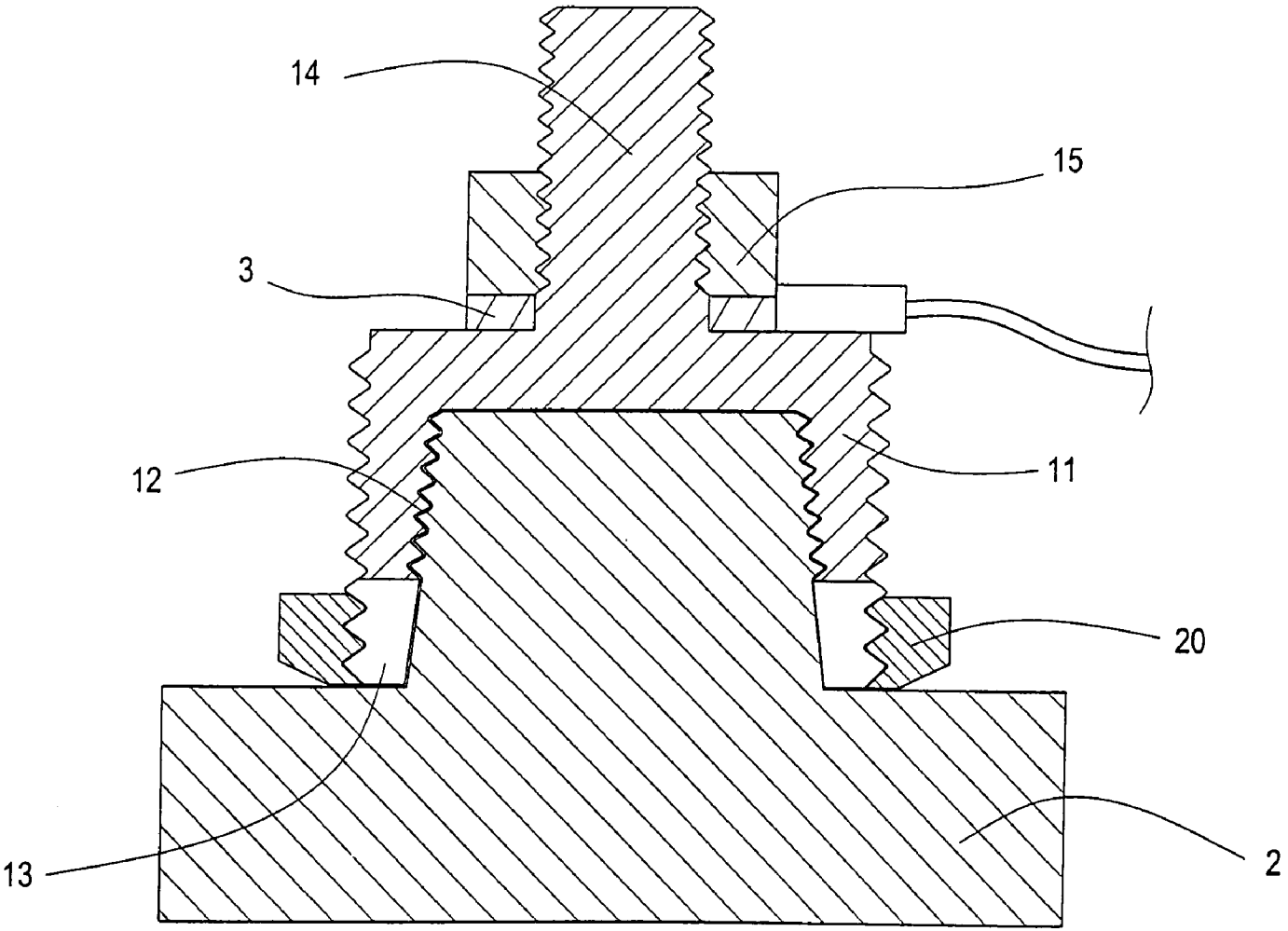
FIG. 3 shows a cross-sectional side view of an assembled post fixing structure and a battery according to the present invention (1).
Figure 4:
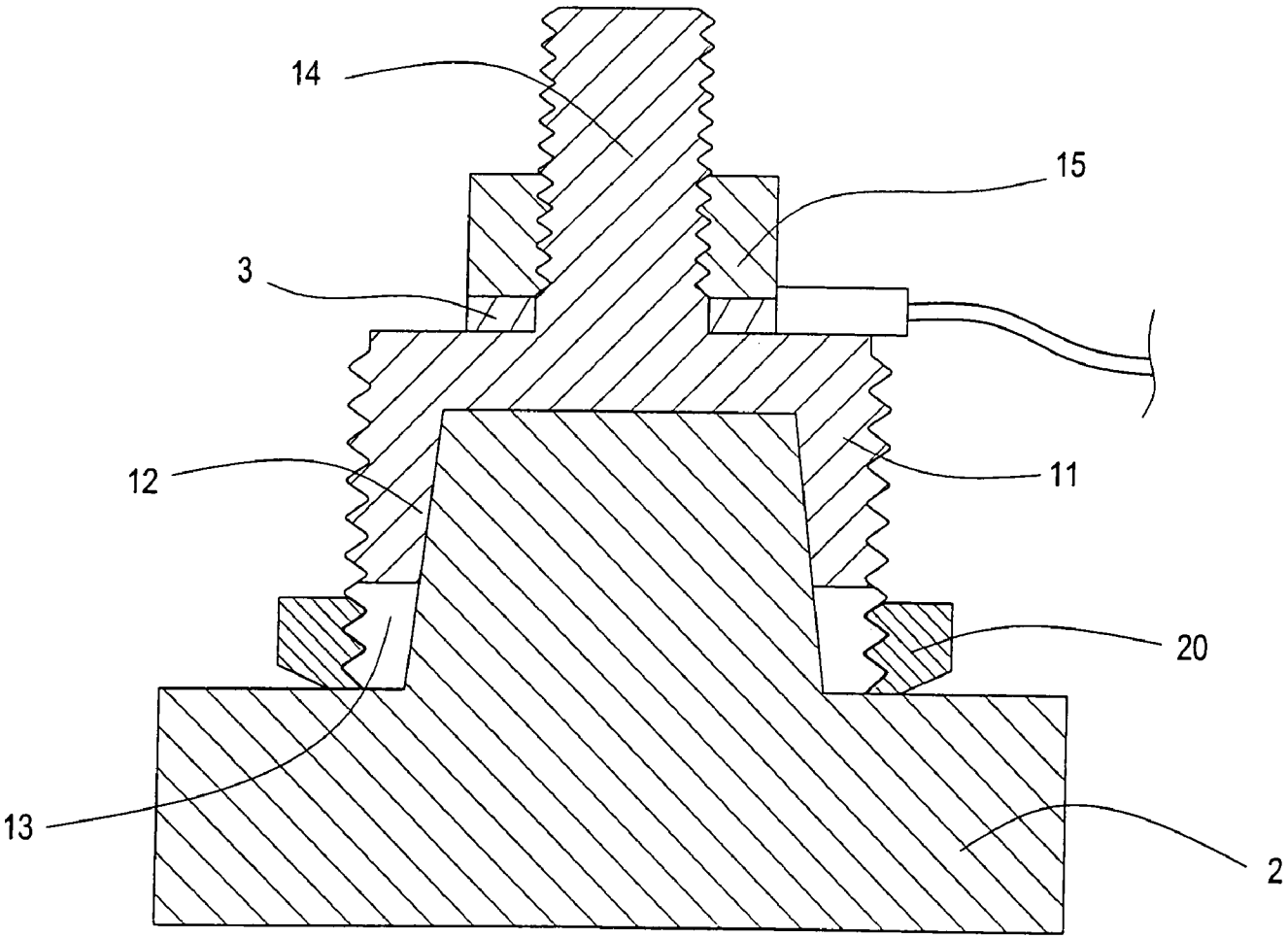
FIG. 4 shows a cross-sectional side view of an assembled post fixing structure and a battery according to the present invention (2).

Referring to FIGS. 2, 3, and 4, which show a car battery post fixing structure of the present invention structured to comprise a fixing cap 10 and a cap nut 20, wherein interior of the fixing cap 10 is formed to correspond to same shape of a battery post 2, and internal diameter of the fixing cap 10 is slightly smaller than that of the battery post 2. A screw thread 11 is configured on an outside wall of the fixing cap 10, and a screw thread 12, which is of type that is in a inverse direction to that of the screw thread 11 of the outside wall, can be configured on an inside wall of the fixing cap 10 or the inside wall is of a smooth threadless type. Moreover, a plurality of grooves 13 are defined on a side edge of an opening of a bottom portion of the fixing cap 10. An extended screw 14 is configured on a top portion external of the fixing cap 10, and which is utilized for a terminal 3 of a car electrical system to slip thereon, whereupon a fixing nut 15 firmly screws down the terminal 3 thereat, whereafter the cap nut 20 is slipped over the top portion of the fixing cap 10 and screws down onto the battery post 2.

Figure 5:
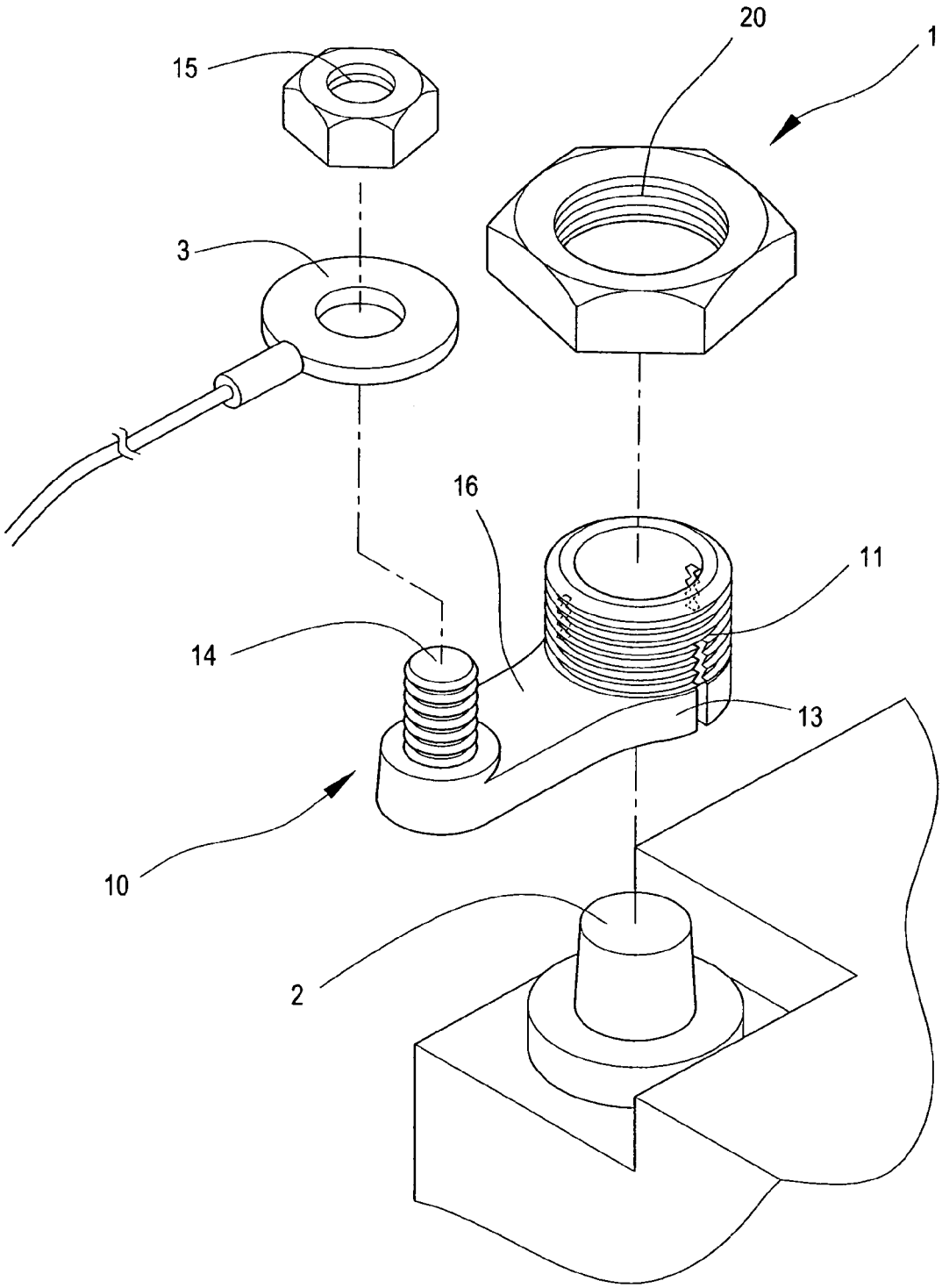
FIG. 5 shows an exploded elevational view of another embodiment according to the present invention.
Figure 6:
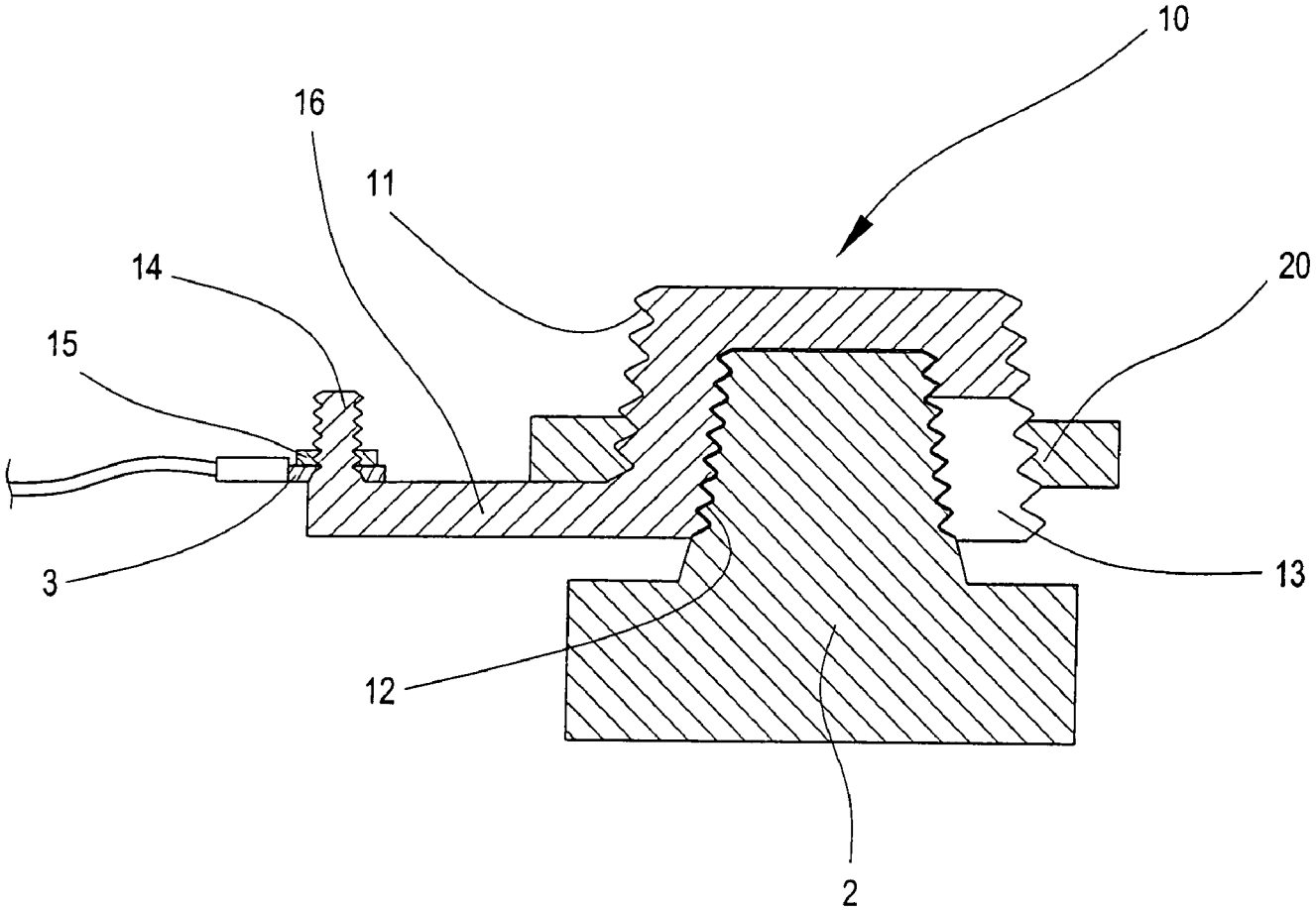
FIG. 6 shows a cross-sectional side view of the other embodiment assembled with a battery according to the present invention (1).
Figure 7:
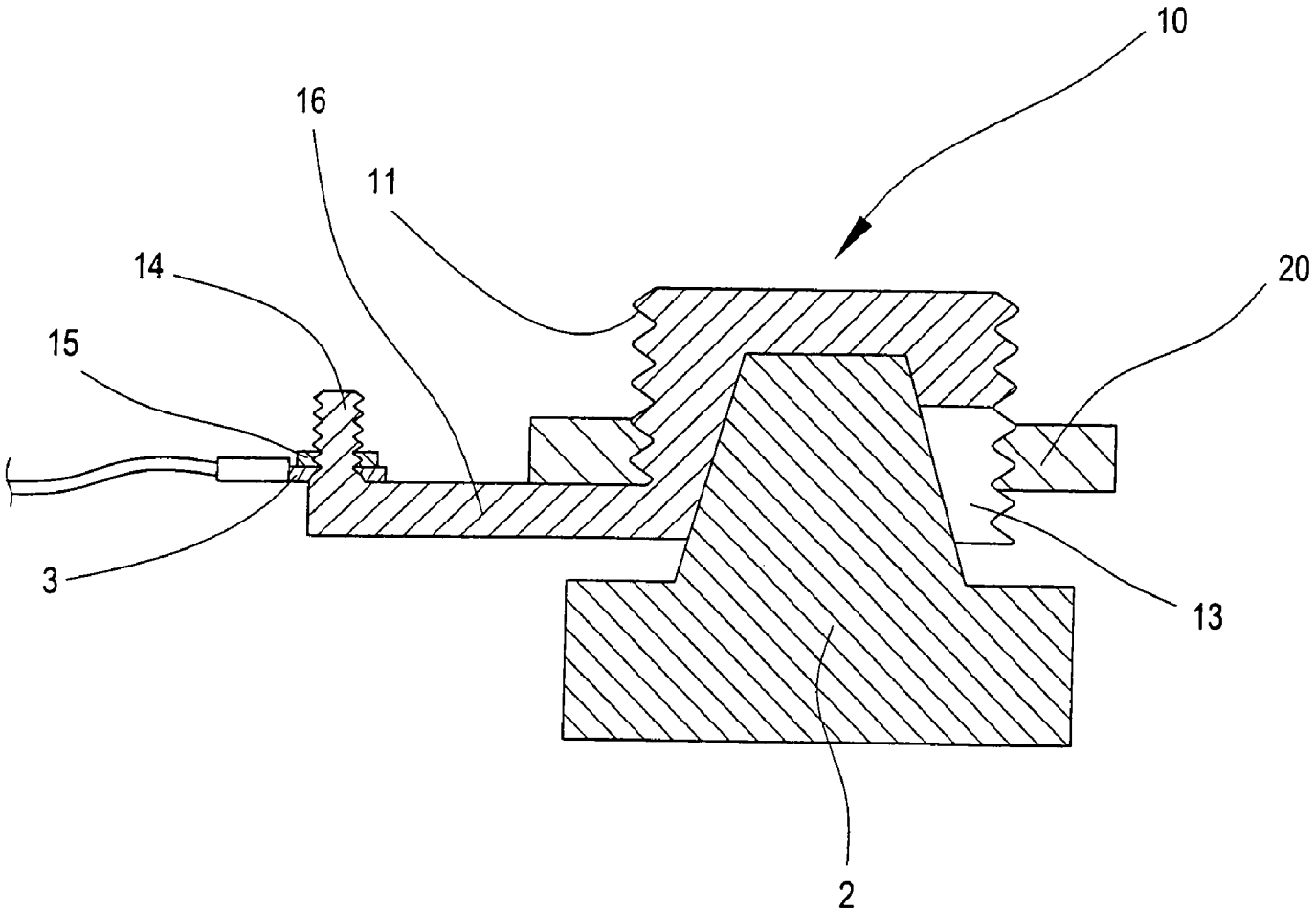
FIG. 7 shows a cross-sectional side view of the other embodiment assembled with a battery according to the present invention (2).

The present invention has additionally designed a fixing structure with same functionality as the aforementioned structural design, however, is able to realize reducing entire height of the fixing structure. Referring to FIGS. 5, 6, and 7, which show the fixing structure configured to comprise a fixing cap 10 and a cap nut 20. Wherein interior of the fixing cap 10 is formed to correspond to same shape of the battery post 2, and internal diameter of the fixing cap 10 is slightly smaller than that of the battery post 2. A screw thread 11 is configured on an outside wall of the fixing cap 10, and a screw thread 12, which is of type that is in a inverse direction to that of the screw thread 11 of the outside wall, can be configured on an inside wall of the fixing cap 10 or the inside wall is of a smooth threadless type. Moreover, a plurality of grooves 13 are defined on a side edge of an opening of a bottom portion of the fixing cap 10. A linking plate 16 outwardly extends from an outside wall of the fixing cap 10, and an extended screw 14 is provided on an extremity of the linking plate 16, and which is utilized for the terminal 3 of the car electrical system to slip thereon, whereupon the fixing nut 15 firmly screws down the terminal 3 thereat, whereafter the cap nut 20 is slipped over the top portion of the fixing cap 10 and screws down onto the battery post 2. Such a structural configuration can thereby prevent height of the structural design from being too high, which would otherwise result in the post fixing structure coming in direct contact with hood of the car, and cause damage to the car electrical system.

In conclusion, the car battery post fixing structure of the present invention utilizes the screw thread of the inside wall of the fixing cap to screw down onto the post fixing structure of a battery, whereafter the cap nut firmly screws down thereon, whereupon each battery terminal is firmly connected to the extended screw of the fixing cap. Advancement and practicability of the present invention comply with essential elements as required for a new patent application. Accordingly, a new patent application is proposed herein.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A car battery post fixing structure, which is configuredly disposed on a car battery, and functions as a fixing structure that connects to a terminal of a car electrical system; and characterized in that: the car battery post fixing structure comprises a fixing cap and a cap nut, wherein interior of the fixing cap is formed to correspond to same shape of a battery post, and internal diameter of the fixing cap is slightly smaller than that of the battery post, a screw thread is configured on an outside wall of the fixing cap, and a screw thread, which is of type that is in a inverse direction to that of the screw thread of the outside wall, is configured on an inside wall of the fixing cap or the inside wall is of a smooth threadless type, moreover, a plurality of grooves are defined on a side edge of an opening of a bottom portion of the fixing cap, an extended screw is configured on a top portion external of the fixing cap, and the cap nut is slipped over the top portion of the fixing cap and screws down onto the battery post thereof.

2. The car battery post fixing structure according to claim 1, wherein the inside wall of the fixing cap is a smooth threadless type.

* * * * *